US006672428B2

(12) United States Patent
Gelman

(10) Patent No.: US 6,672,428 B2
(45) Date of Patent: Jan. 6, 2004

(54) PERSONAL DESCENT APPARATUS

(76) Inventor: Boris Gelman, a32-10 alkent-2000, b.cakmece, 34900 Istanbul (TR)

( * ) Notice: Subject to any disclaimer, the term of this patent is extended or adjusted under 35 U.S.C. 154(b) by 0 days.

(21) Appl. No.: 10/085,291

(22) Filed: Feb. 28, 2002

(65) Prior Publication Data

US 2003/0159887 A1 Aug. 28, 2003

(51) Int. Cl.[7] ..... A62B 1/12; B66D 5/02

(52) U.S. Cl. ..... 182/233; 182/238; 254/377

(58) Field of Search ..... 182/233, 232, 182/238, 231; 254/377; 188/266, 65.1, 65.2, 65.3, 65.4; 242/396.9, 396.5

(56) References Cited

U.S. PATENT DOCUMENTS

| | | | | |
|---|---|---|---|---|
| 27,127 A | | 2/1860 | Heydrich | |
| 199,461 A | | 1/1878 | Nunn | |
| 285,564 A | | 9/1883 | Brooks | |
| 437,091 A | | 9/1890 | Carr | |
| 650,403 A | | 5/1900 | Larsson | |
| 696,931 A | | 4/1902 | Boettcher | |
| 991,768 A | | 5/1911 | Busat | |
| 2,526,065 A | | 10/1950 | Chodacki et al. | |
| 4,162,717 A | | 7/1979 | Orii et al. | |
| 4,287,963 A | | 9/1981 | Coxsey | |
| 4,452,339 A | | 6/1984 | Raymaker | |
| 4,503,933 A | | 3/1985 | O'Neil | |
| 4,508,285 A | * | 4/1985 | McMillan | 182/231 X |
| 4,520,900 A | | 6/1985 | Orgeron | |
| 4,616,735 A | | 10/1986 | Orgeron | |
| 4,640,388 A | * | 2/1987 | Walborn | 182/231 |
| 4,645,034 A | * | 2/1987 | Griffith | 182/231 |
| 4,653,609 A | | 3/1987 | Devine | |
| 5,320,195 A | | 6/1994 | Reece et al. | |
| 5,343,981 A | | 9/1994 | Schroemges et al. | |
| 5,494,133 A | | 2/1996 | Green et al. | |
| 5,586,617 A | | 12/1996 | England et al. | |
| 5,690,187 A | | 11/1997 | Wang et al. | |
| 5,779,000 A | | 7/1998 | Lin | |
| 5,794,880 A | * | 8/1998 | Liljedahl | 182/233 X |
| 5,826,679 A | | 10/1998 | Chern | |
| 6,371,244 B2 | * | 4/2002 | Okamura | 182/231 X |

* cited by examiner

*Primary Examiner*—Hugh B. Thompson
(74) *Attorney, Agent, or Firm*—G.E. Ehrlich (1995) Ltd

(57) ABSTRACT

A small and easily portable apparatus for safely descending from a high elevation, comprising a drum rotatably mounted on a mounting frame; a body securing device for securing the mounting frame to the body of a user; and a line wound around the drum, having an end for attachment to a fixed object at the high elevation; such that the user may attach the line to a fixed object and safely descend from the high elevation.

22 Claims, 5 Drawing Sheets

PERSONAL DESCENT APPARATUS

FIELD AND BACKGROUND OF THE INVENTION

The present invention relates to the field of evacuation devices and, more particularly, to a personal descent apparatus designed to safely lower one person from a high elevation if emergency evacuation is needed.

Fires are known to be an inherent danger of tall buildings, and one of the primary design requirements of such buildings is the capability to rapidly evacuate occupants. However, it often occurs that evacuation is not possible for some occupants, particularly those on upper floors, as a result of damage to stairs and exits on the lower floors. If not rescued, these occupants often succumb as a result of smoke inhalation, burning or jumping to their deaths from a window.

Providing a safe means of escape from tall buildings has been the subject of much inventive energy and a long history of prior art exists, including U.S. Patents issued as long ago as 1860 and continually thereafter. However, there is not known to exist a descent device that is both easily portable and automatically operable.

Most of the devices disclosed are for permanent attachment to a building, many in clever or decorative ways, such as by being hidden in cornices (e.g., U.S. Pat. No. 27,127) or under window sills (e.g., U.S. Pat. No. 285,564). Many other of such devices are not permanently affixed to a building but are permanently deployed within a building for use when necessary. Such devices are employed by being attached to hooks, brackets or fixtures that are permanently affixed to the building for the specific purpose of the device.

All such devices consist of mechanical means for lowering a person from a window or a roof. They generally include levers, rods, gears, pulleys, winches or windlasses, springs, and the like, which cause the device to be heavy and often quite bulky. Accordingly, these devices are not portable, their use being limited to the location where they are deployed.

A number of U.S. Patents disclose such descent devices deployed on or within a building for use by occupants thereof, including: U.S. Pat. Nos. 199,461; U.S. Pat. No. 437,091; U.S. Pat. No. 696,931; U.S. Pat. No. 650,403; U.S. Pat. No. 991,768; U.S. Pat. No. 2,526,065; U.S. Pat. No. 4,287,963; U.S. Pat. No. 4,416,735; U.S. Pat. No. 4,452,339; U.S. Pat. No. 4,503,933; U.S. Pat. No. 5,343,981; U.S. Pat. No. 5,494,133; and U.S. Pat. No. 5,586,617.

Another limitation suffered by almost all such devices is the requirement of affirmative operation or control. It is necessary for the user to manually operate the device in one fashion or another in order to descend safely. It has been observed that, when faced with the decision whether to burn to death or jump from a high window, the average person's concentration and manual dexterity diminish substantially and are not sufficient to enable effective operation of a mechanical device. Many of the prior art devices include such a requirement.

A small and portable descent device is disclosed in U.S. Pat. No. 5,690,187, which is a travel bag fabricated from a flat rope that may be released and used to lower oneself from a high elevation. This device meets the first need of being easily portable, but it does not provide automatic operation. The rope must be manually released by the user operating a controlled release mechanism which allows the rope to pay out in a controlled fashion, an act which a person in high stress may not be able to accomplish. This device sufferers an additional and substantial deficiency in that the rope may burn or have its tensile strength weakened by fire or heat, and is therefore of questionable suitability in a fire situation.

SUMMARY OF THE INVENTION

Accordingly, it is an object of the present invention to provide an apparatus that allows a person to safely descend from a high elevation under emergency conditions.

It is a further object of the present invention to provide a small and personally portable descent apparatus that a user may easily carry on his/her person when entering high elevations.

It is a yet further object of the present invention to provide a descent apparatus that operates automatically and allows a user to descend simply by applying weight thereto, with no requirement of operation or control.

It is a still further object of the present invention to provide a reliable and durable descent apparatus that requires no maintenance.

It is a yet still further object of the present invention to provide a personal descent apparatus that is simple and inexpensive to manufacture and acquire.

According to the present invention there is provided an apparatus for use by a user for safely descending from a high elevation comprising: (a) a drum rotatably mounted on a mounting frame; (b) a body securing device for securing the mounting frame to the body of the user; and (c) a line wound around the drum having a first end attached to the drum and a second end for attachment to a fixed object at the high elevation; such that the user may conveniently use the device to safely descend from the high elevation by attaching the mounting frame to the user's body and the second end of the line to the fixed object at the high elevation.

According to features in the described preferred embodiments the mounting frame includes a housing for containing the drum.

According to features in the described preferred embodiments the second end of the line includes an attachment device for attaching the line to the fixed object at the high elevation, the attachment device being an openable and closable clasp.

According to features in the described preferred embodiments the body securing device includes a body attachable member for holding the body of the user, the body attachable member being a harness or a jacket.

According to features in the described preferred embodiments the body securing device includes a body receiving member for receiving the body of the user.

According to features in the described preferred embodiments the apparatus comprises a descent control device for controlling the rate of descent of the user.

According to features in the described preferred embodiments the descent control device comprises an oil damper disposed in association with the drum for retarding rotation of the drum.

According to features in the described preferred embodiments the descent control device is adjustable to vary the rate of descent of the user.

According to features in the described preferred embodiments the apparatus comprises a generator driven by rotation of the drum for producing an electric current to power an indicator signal.

According to features in the described preferred embodiments the fixed object at the high elevation is a building or a structure.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
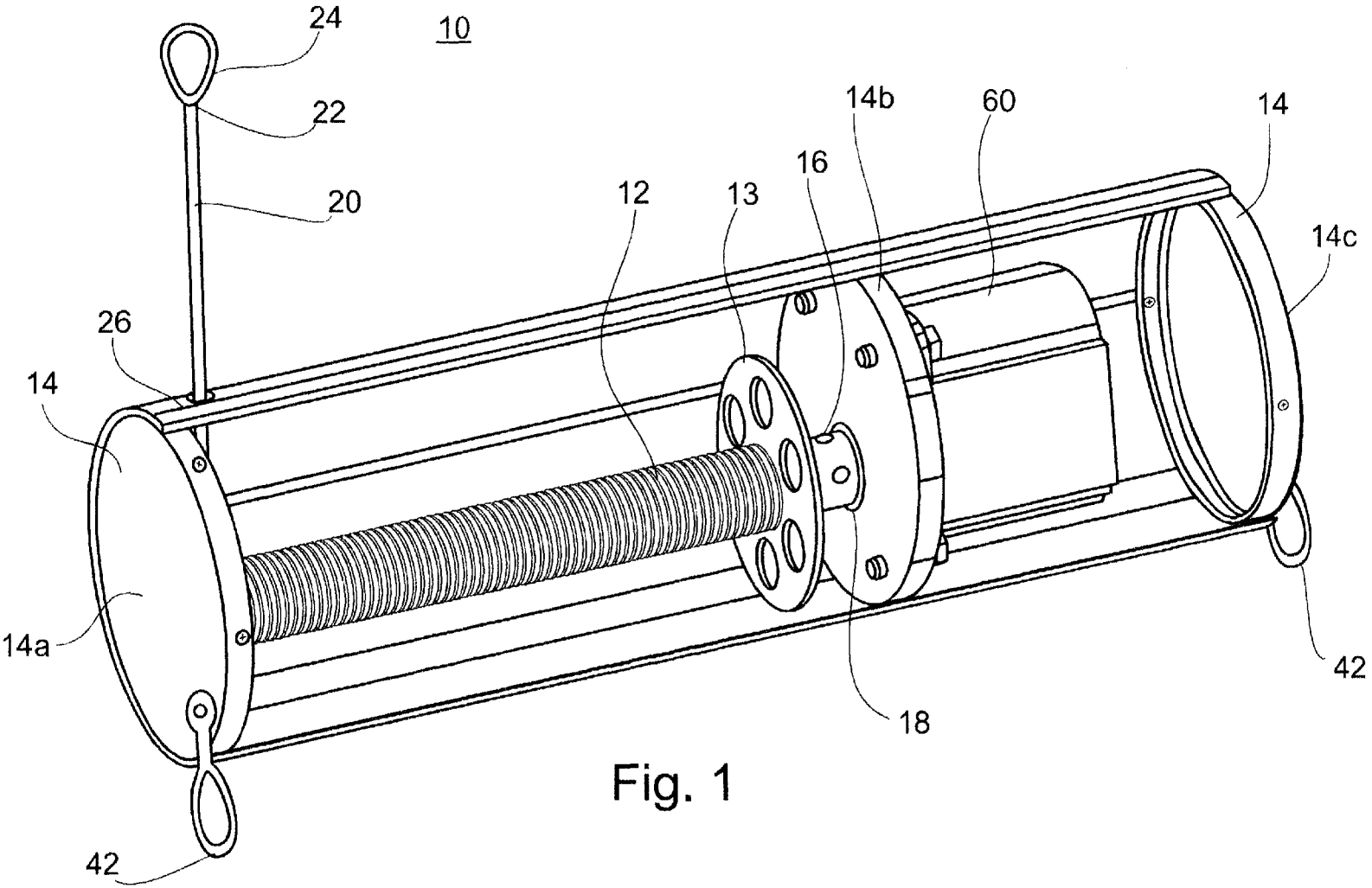
FIG. 1 is a diagrammatic interior view of a preferred embodiment of a personal descent apparatus constructed in accordance with the present invention.

Before explaining at least one embodiment of the invention in detail, it is to be understood that the invention is not limited in this application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

The principles and operation of a personal descent apparatus according to the present invention may be better understood with reference to the drawings and accompanying descriptions.

FIG. 1 shows a personal descent apparatus 10 constructed in accordance with the present invention in the form of a device which is sufficiently small and light in weight to be easily portable by a user. Apparatus 10 includes a drum 12 which is rotatably mounted on a mounting frame 14 which, according to the preferred embodiment, consists of two parallel circular plates, designated 14*a* and 14*b* respectively. The essential functions of mounting frame 14 include both to rotatably mount drum 12 and to securely attach apparatus 10 to the body of a user.

Mounting frame 14 rotatably mounts drum 12 by supporting shaft 16 which is positioned between plates 14*a* and 14*b*. The ends of shaft 16 are supported by plates 14*a* and 14*b* respectively in such a manner that shaft 16 may rotate with respect thereto. Each end of shaft 16 is supported by a bearing 18 which allows it to rotate relative to plates 14*a* and 14*b*. It is understood that bearing 18 is not a material element of the invention and may be replaced by a bushing or any other holding device that allows shaft 16 to rotate. Drum 12 is fixed coaxially on shaft 16 such that both drum 12 and shaft 16 rotate together with respect to mounting frame 14.

Mounting frame 14 is attached to the body of a user by two body attachment clasps 42. Clasps 42 are securely attached to mounting frame 14 and may be any model of the many easily openable and securely closable clasps known in recreation and industry today for rapidly engaging a ring, clasp or link. Clasps 42 will engage a set of corresponding attachment members upon the body of a user, thus securely attaching mounting frame 14 to the user.

Mounting frame 14 may take other forms or shapes in alternate embodiments provided that such form or shape allows it to both rotatably support drum 12 and to be secured to the body of a user.

Apparatus 10 also includes a line 20 wound around drum 12 which has one of its ends attached to drum 12 and a second end 22 extending freely in order to attach to a fixed object from which the user wishes to descend. For this purpose, second end 22 includes an attachment device which, according to the preferred embodiment, is a clasp 24. Clasp 24 has a segment that opens and closes and is similar in form and function to clasps customarily used by climbers and tradesmen to attach a cable to an object. The attachment device may also be a hook, knob, loop or other appropriate attaching element depending upon the nature of the object to which second end 22 is to be attached.

According to the preferred embodiment, line 20 is a stainless steel cable preferably 3–4 mm in diameter. Such a cable possesses attributes needed for the preferred embodiment of apparatus 10 which is as an evacuation device in case of fire. Such cable provides both sufficient tensile strength and resistance to fire and heat. It is understood that line 20 may be formed of other materials, such as nylon, polypropylene, etc., according to alternative applications. All such embodiments are contemplated.

Line 20 is wound around drum 12 such that a sufficient length may be concisely stored thereon for use when needed. To keep line 20 in an orderly fashion, drum 12 includes drum end 13 which is formed as a circular flange radiating axially from shaft 16 to serve as a physical barrier to guide the winding of line 20, thus keeping line 20 confined between drum end 13 and the other end of drum 12 which is proximal to plate 14*a*. Drum end 13 may be positioned a distance from plate 14*a* as may be appropriate for the length of line 20 needed for the particular application.

According to the preferred embodiment, mounting frame 14 preferably includes a housing 26 which contains drum 12. Housing 26 is attached to the outer circumferential surfaces of plates 14*a* and 14*b* and forms a wrap around their respective circumferences, thus forming a cylindrical shape with drum 12 positioned longitudinally therein. Housing 26 extends beyond plate 14*b* in order to cover additional elements of apparatus 10 and therefore includes a third circular plate 14*c* at its terminal in order to close this end. In such a configuration, each of plates 14*a* and 14*c* has affixed thereto a body attachment clasp 42 for the purpose of securing mounting frame 14 to the body of the user.

FIG. 1 depicts apparatus 10 with approximately one half of housing 26 removed to allow a view of the interior of apparatus 10. It is appreciated that housing 26 may take other forms or shapes and that it is not essential for the functioning of apparatus 10, but rather provides a protective function. Housing 26 is formed with an opening therein (not shown) to allow the passage therethrough of line 20 when apparatus 10 is in use.

Apparatus 10 also includes a descent control device for controlling the rate of descent which, according to the preferred embodiment, is an oil damper 60. Oil damper 60 is mounted upon plate 14*b* and, as more fully described hereinafter, is disposed in association with drum 12 such that the rotation of drum 12 is retarded and held to a constant rate, thus restricting the payout of line 20 to a constant speed.

Figure 2:
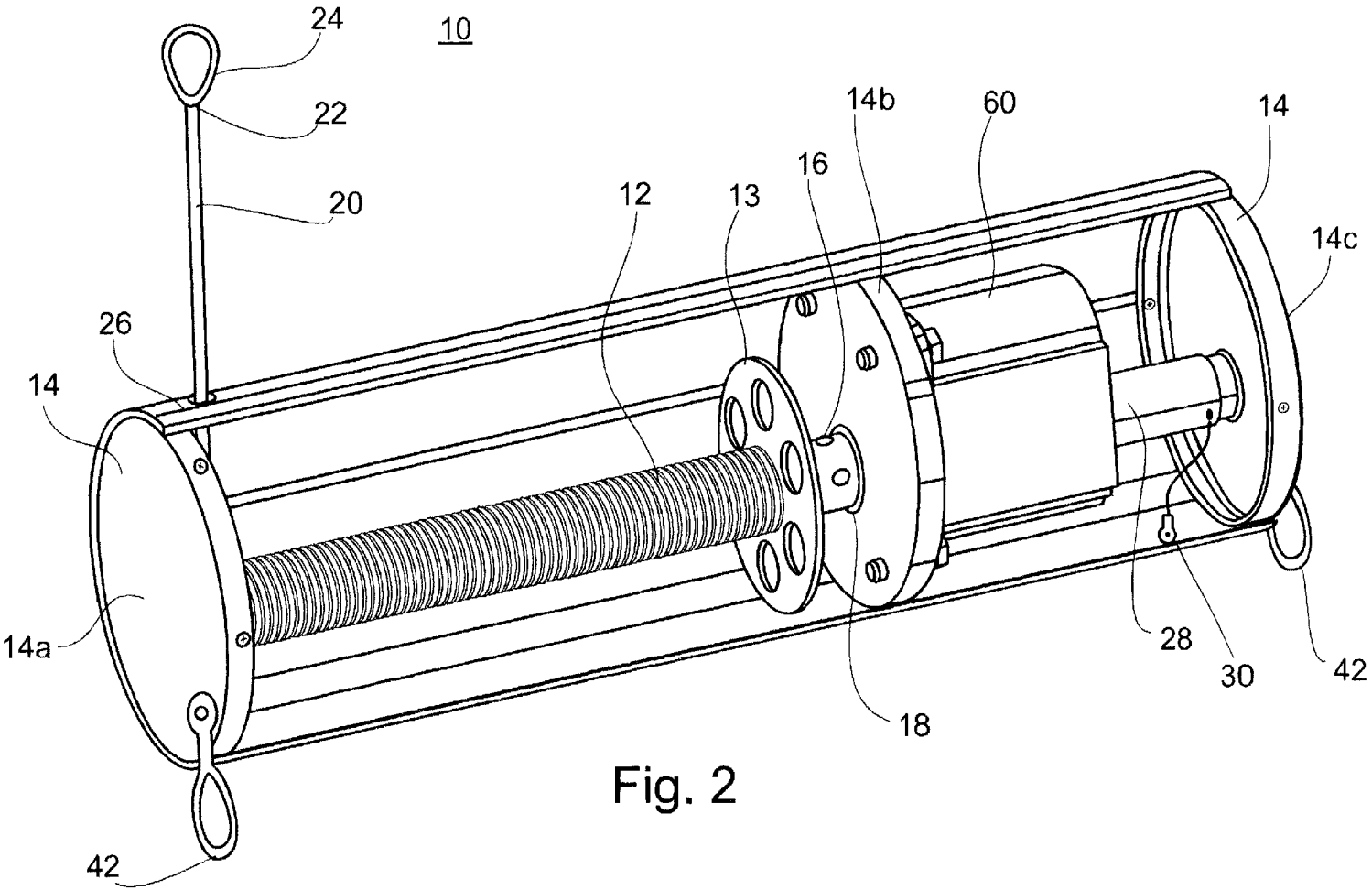
FIG. 2 is a diagrammatic interior view of an alternate embodiment of the apparatus of FIG. 1.

FIG. 2 depicts an alternative embodiment of apparatus 10 which is configured and functions as does the preferred embodiment but that additionally includes a generator 28 for generating an electrical current for powering an indicator signal in the form of light source 30. According to the alternative embodiment, a rotatable shaft 17 extends from oil damper 60 in a direction opposite the direction of shaft 16. Shaft 17 is driven by the rotation of shaft 16 and generator 28 is activated by the rotation of shaft 17. When shaft 17 rotates, generator 28 produces a small electric current of preferably 5*v* which is transmitted to light source 30, such that light source 30 lights up as a signal that the user is descending. Such small generators are well known in the art and therefore it is not necessary to provide a description or explanation herein. It is understood that this feature is not essential for the functioning of apparatus 10 and may be omitted. It is further understood that apparatus 10 may, in further alternative embodiments, be equipped with an audible signal indicating descent, or a variable signal, either audible or visible, indicating rate of descent, proximity to the ground, elapsed time or other variables.

Figure 3A:
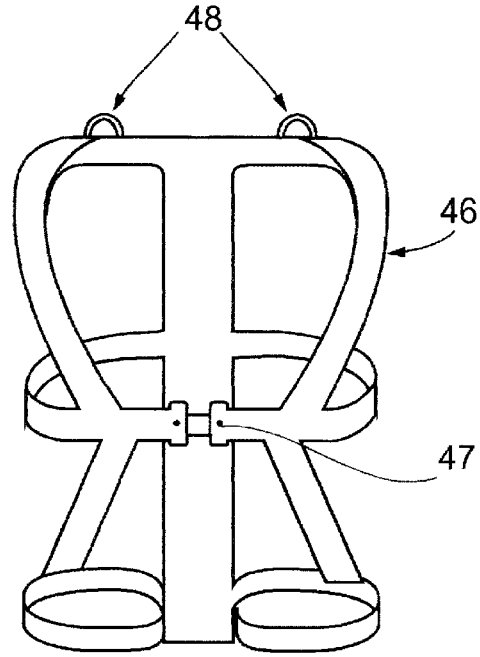
FIG. 3*a* is a pictorial illustration of a preferred embodiment of the body securing device of the apparatus of FIG. 1.

Apparatus 10 comprises a body securing device 40 for securing mounting frame 14 to the body of a user. FIG. 3, comprising three illustrations respectively numbered 3*a*, 3*b* and 3*c*, depicts three different embodiments of body securing device 40. FIG. 3*a* shows a body attachable member in the form of harness 46 which may be used to rapidly enclose a user, and is rapidly openable and closable by means of clasp 47. The version of harness 46 shown has straps in a certain configuration. It is understood that harness 46 may be of any design known that is suitable for holding the body of a person in a suspended position for an appropriate period of time. Harness 46 includes on the upper back area two attaching rings 48 spaced apart a distance compatible to the spacing of body attachment clasps 42 of mounting frame 14. Apparatus 10 is thus attached to the body of a user by the user donning harness 46 and engaging attachment clasps 42 with attaching rings 48.

Figure 3C:
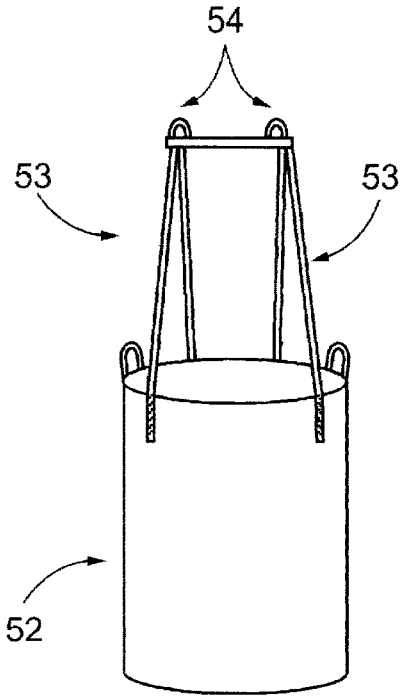
FIG. 3*c* is a pictorial illustration of an alternative embodiment of the body securing device of the apparatus of FIG. 1.
Figure 3B:
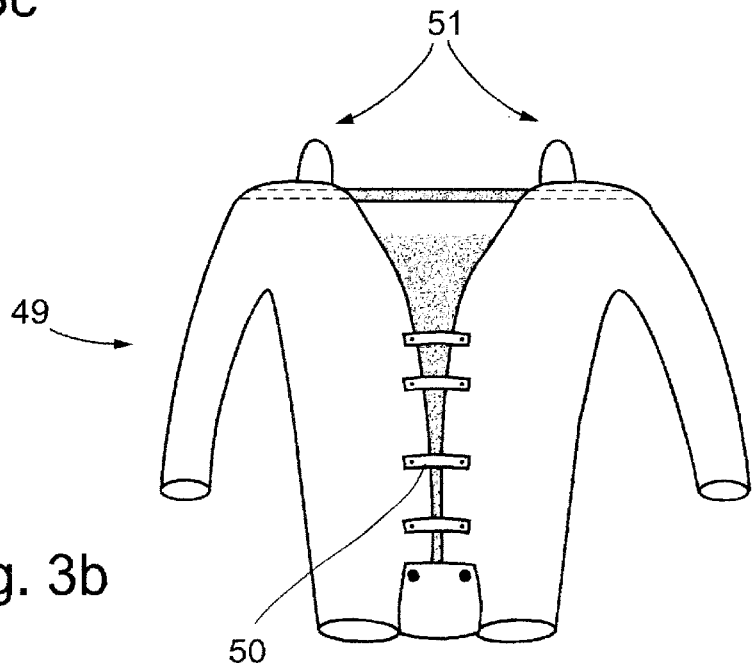
FIG. 3*b* is a pictorial illustration of an alternative embodiment of the body securing device of the apparatus of FIG. 1.

FIG. 3*b* shows a body attachable member in the form of jacket 49 which may be worn by a user. Jacket 49 resembles a normal jacket in that it has sleeves and a series of fasteners in a vertical orientation down the front. Jacket 49 is dissimilar to a normal jacket in that it is preferably made of extremely strong material, has securely closable fasteners instead of buttons, and further encloses the wearer's legs and provides closure and support between the legs so that the wearer may be held therein in a suspended position. The design and configuration of jacket 49 may vary, provided that it holds a user securely and without discomfort. Jacket 49 also includes on the upper back area two attaching rings 51 spaced apart a distance compatible to the spacing of body attachment clasps 42 of mounting frame 14. Apparatus 10 is thus attached to the body of a user by the user donning and closing jacket 49 and engaging attachment clasps 42 with attaching rings 51.

FIG. 3*c* shows a body receiving member in the form of basket 52, into which an unconscious, semi conscious or fearfully paralyzed user may be placed and lowered. Basket 52 may be of any type provided that it is stable and will securely retain the user's body. Basket 52 preferably has sufficiently high walls so that sudden or jerky movements, such as may be caused by bumping into objects during descent, will not dislodge or eject the body. Basket 52 will have a connecting harness 53 that includes two attaching rings 54 spaced apart a distance compatible to the spacing of body attachment clasps 42 of mounting frame 14. Apparatus 10 is thus employed by a user engaging attachment clasps 42 with attaching rings 54 and entering basket 52.

Figure 4:
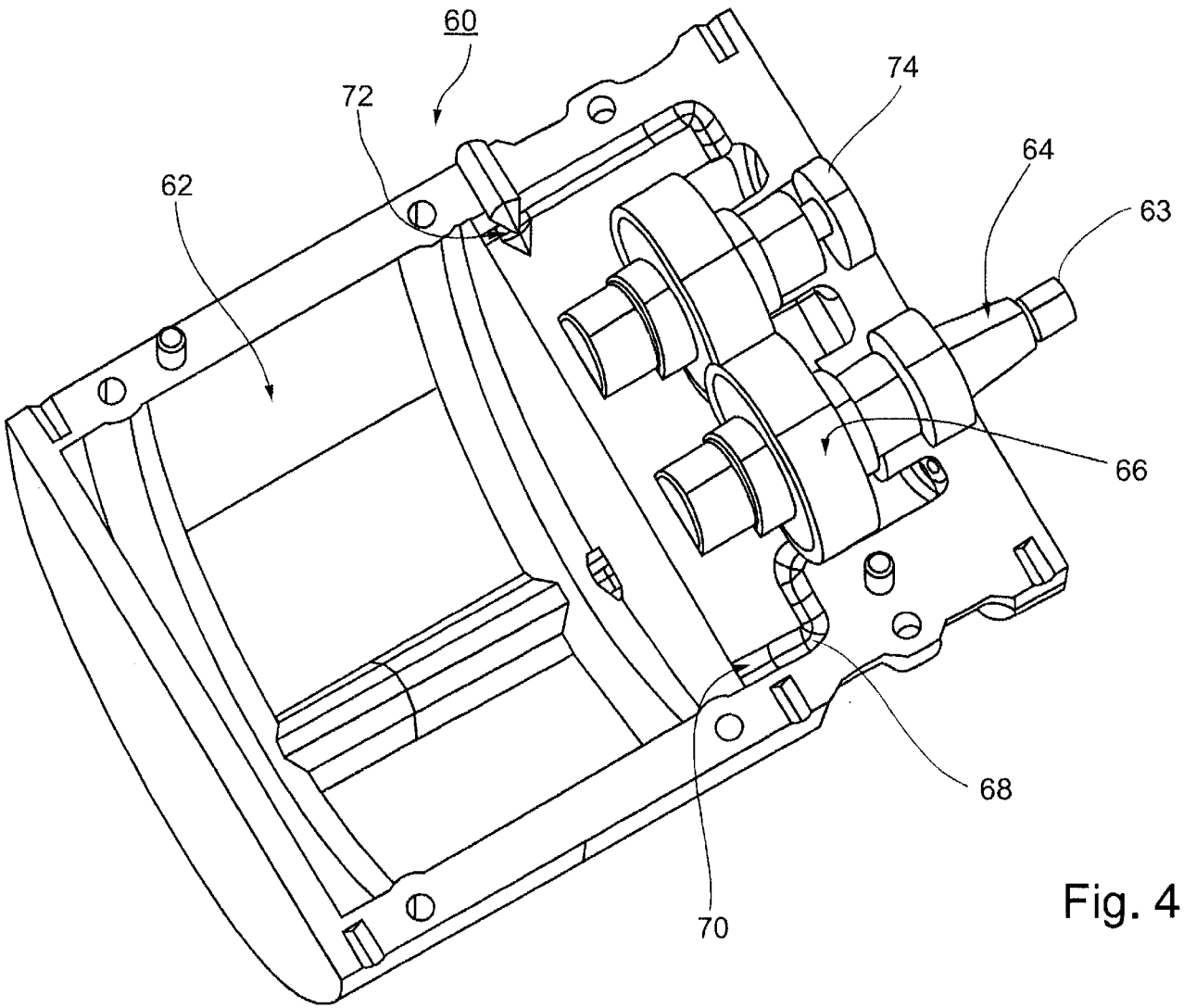
FIG. 4 is a diagrammatic interior view of the oil damper of the apparatus of FIG. 1.

FIG. 4 shows the internal structure of oil damper 60. Oil damper 60 is of the type that employs a pumping action to move oil against resistance. According to the preferred embodiment, oil damper 60 includes an oil reservoir 62 which contains a quantity of oil, a rotatable shaft 63 which operates pump mechanism 66 for drawing oil from reservoir 62 into inlet 70 of flow channel 68 and moving it through channel 68 until it flows out of outlet 72 back into reservoir 62. Shaft 63 is rotatably associated with shaft 16 such that the rotation of shaft 16 causes the rotation of shaft 63 which effects the pumping action of oil damper 60. According to the preferred embodiment, shaft 63 includes a cone shaped connecting element 64 for attachment to shaft 16. Shaft 16 is formed with a complementary concavity (not shown) to engage connecting element 64 such that shaft 16 and shaft 63 are securely affixed one to the other and rotate together. Accordingly, the rotation of shaft 16 and drum 12 are retarded by the resistance provided by oil damper 60.

Oil damper 60 also includes a flow adjustment means in the form of screw 74 that serves to narrow channel 68 and thus provide even greater resistance to the flow of oil therethrough, causing greater retardation of the rotation of shaft 16. Flow adjustment screw 74 is operable by a user prior to the deployment of apparatus 10 in order to cause a faster or slower descent. Rotating screw 74 clockwise serves to occlude channel 68, thus impeding the flow of oil therethrough to a greater extent, causing stronger resistance to the pumping action and further retarding the rotation of drum 12. Rotating screw 74 counter clockwise has the opposite effect. The rotation rate of shaft 16 is thus variable to provide a descent rate preferably ranging from one meter per second to four meters per second. Accordingly, when screw 74 is in its maximally restrictive state, the flow through channel 68 allows a rate of rotation equal to a descent rate of approximately one meter per second.

Oil damper 60 is an example of one of many oil dampers on the market that are used for exerting a retarding force on rotational movement. Many such dampers are known that provide resistance to moving baffles or vanes within a high viscosity/high pressure environment, or that provide resistance by pumping oil through a restrictive channel. Neither the design, construction nor method used by oil damper 60 are elements of the present invention and any form of oil damper may be deployed within apparatus 10 provided that it retards the rotation of shaft 16 and drum 12 to the appropriate constant speed.

Moreover, it is understood that apparatus 10 may, in alternative embodiments, employ other types of descent control devices, such as a caliper brake on drum end 13, a compression brake on shaft 16, a friction device on the passage of line 20 or any other movement retarding device or method known in the art for the purpose of retarding the rate of rotation of drum 12 and restricting the payout of line 20 to a constant appropriate speed.

Figure 5:
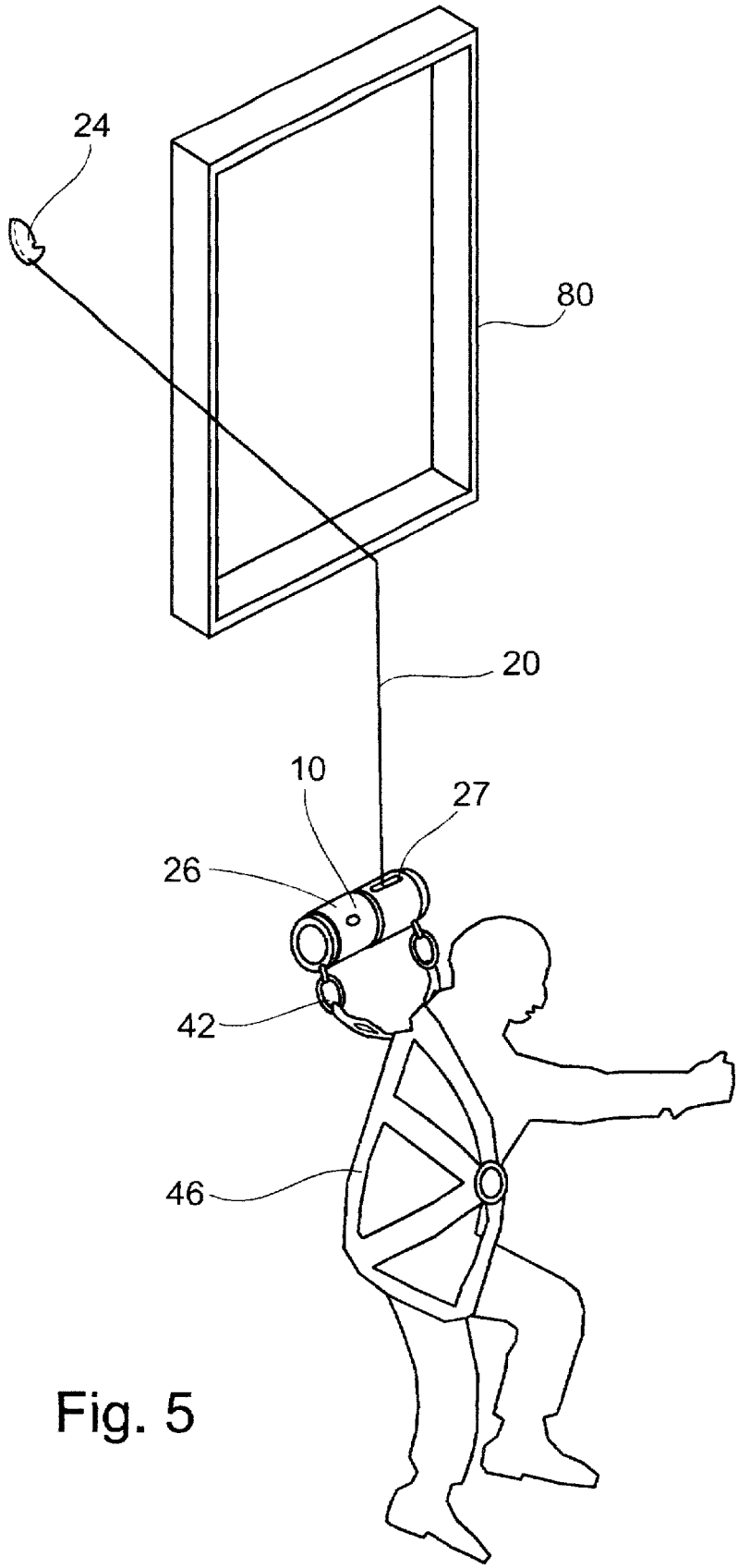
FIG. 5 is an illustration of the apparatus of FIG. 1 in use.

FIG. 5 shows a user of apparatus 10 dangling out of a window 80. Mounting frame 14 is attached to harness 46 with the user secured therein. Line 20 is payed out of housing 26 via an opening 27 formed therein for that purpose, with second end 22 attached to an unseen fixed point within window 80. As can be seen, there is no control or operating parts, elements or mechanisms. Accordingly, apparatus 10 is idiot-proof; there is nothing that a user need do in order to descend safely. For this reason, apparatus 10 is ideally suited to be used for the evacuation of unconscious persons or users who are non functional due to injury, anxiety or any other cause.

The user descends solely as a result of the body weight being applied to line 20. The tension on line 20 exerts rotational force upon drum 12, which causes drum 12 and shaft 16 to rotate, the rotation being retarded and held to a constant rate by oil damper 60. It is to be noted that the rate of rotation is constant irrespective of the amount of weight applied to line 20. Apparatus 10 is so designed that any weight between 50 Kg and 150 Kg will result in the same rate of descent, irrespective of how that weight is applied to line 20. Accordingly, an alternate use of apparatus 10 is to reverse orientation by attaching mounting frame 14 to a fixed point on the high elevation and attaching to the user by means of attachment clasp 24 at the end of line 20. Apparatus 10 will function in precisely the same manner as if the orientation was reversed.

According to the preferred embodiment, the personal descent apparatus is designed as a one-use emergency evacuation device for escape from a burning building. For this reason, it is preferably constructed of metal with all of its elements impervious to the effects of fire and high temperatures. It is reasonable to foresee alternative embodiments for other applications such as mountain or rock climbing, or as a safety device for window washers on tall buildings, bridge painters, linemen who climb high poles, lumberjacks who ascend tall trees or other uses presently unknown. Such alternative applications may dictate many variations in design and/or configuration, such as lines of varying lengths or of different materials; fabrication of lightweight materials, extending the rotating shaft out through the side of the housing and configured to accept a handle for manually rotating the drum in a reverse direction in order to rewind the line for subsequent use; a smaller mounting frame with line pay out being effected by a lower weight for evacuating babies or children; different attachment means, both for the apparatus and for the user; and other variations that may be apparent or obvious to one skilled in the art. The present invention contemplates all such embodiments.

The present invention provides a number of advantages over devices presently known and in use for evacuation from a burning building, including the following:

1. The apparatus is small and portable. Each person may bring his own and be certain that there is a means of evacuation should the need arise
2. There is no need to wait for a descent device to be available.
3. The user of the personal descent apparatus is not dependent on others. All that is required is that the user attach the free end of the line to a fixed point within the building and the housing to his/her body and then exit the window.
4. The apparatus is small and storable. A sufficient number may be stored within each room of a building to be supplied to all occupants thereof.
5. The apparatus is sturdy, durable, and reliable. There are only a few relatively simple moving parts, with nothing electronic nor electric nor dependent on delicate or temperamental technology that may fail.
6. The apparatus is simple and economical to manufacture and to acquire. Each occupant of a building may own one and employers can afford to supply each worker with one.

It will be appreciated by persons skilled in the art that the present invention is not limited to what has been particularly shown and described hereinabove. Rather, the scope of the present invention is defined by the appended claims and includes both combinations and subcombinations of the various features described hereinabove as well as variations and modifications thereof which would occur to persons skilled in the art upon reading the foregoing description. Accordingly, it is intended to embrace all such alternatives, modifications and variations that fall within the spirit and broad scope of the appended claims.

What is claimed is:

1. A portable, lightweight apparatus for use by a user for safely descending from a high elevation, said apparatus comprising:

(a) a drum rotatably mounted on a mounting frame;

(b) a body securing device for securing said mounting frame to the body of the user; and (c) a line wound around the drum, said line having a first end attached to the drum and a second end for attachment to any fixed object at the high elevation; such that the user may conveniently use the device to safely descend from the high elevation by attaching the mounting frame to the user's body and the second end of the line to the fixed object at the high elevation; and (d) a descent control device comprising an oil damper including a shaft coaxially coupled to said drum wherein drum rotation causes said oil damper to pump oil through a channel against resistance, said resistance exerting a retarding force against said rotation of said drum thereby controlling the rate of descent of the user.

2. The apparatus of claim 1, wherein said mounting frame includes a housing for containing the drum.

3. The apparatus of claim 1, wherein said second end of the line includes an attachment device for attaching the line to the fixed object at the high elevation.

4. The apparatus of claim 3, wherein said attachment device is an openable and closable clasp.

5. The apparatus of claim 1, wherein said body securing device includes a body attachable member for holding the body of the user.

6. The apparatus of claim 5, wherein said body attachable member is a harness for application to the body of the user.

7. The apparatus of claim 5, wherein said body attachable member is a jacket to be worn by the user.

8. The apparatus of claim 1, wherein said body securing device includes a body receiving member for receiving the body of the user.

9. The apparatus of claim 1, wherein said descent control device is adjustable to vary the rate of descent of the user.

10. The apparatus of claim 1, wherein said oil damper comprises a screw for adjusting the rate of flow of oil through said channel, said screw being operable prior to the descent of said user.

11. An apparatus for use by a user for safely descending from a high elevation, said apparatus comprising:

(a) a drum rotatably mounted on a mounting frame;

(b) a body securing device for securing said mounting frame to the body of the user;

(c) a line wound around the drum, said line having a first end attached to the drum and a second end for attachment to a fixed object at the high elevation; and (d) a generator driven by rotation of the drum for producing an electric current to power an indicator signal such that the user may conveniently use the device to safely descend from the high elevation by attaching the mounting frame to the user's body and the second end of the line to the fixed object at the high elevation.

12. The apparatus of claim 11, wherein said indicator signal is a light.

13. The apparatus of claim 11, wherein said mounting frame includes a housing for containing the drum.

14. The apparatus of claim 11, wherein said second end of the line includes an attachment device for attaching the line to the fixed object at the high elevation.

15. The apparatus of claim 14, wherein said attachment device is an openable and closable clasp.

16. The apparatus of claim 11, wherein said body securing device includes a body attachable member for holding the body of the user.

17. The apparatus of claim 16, wherein said body attachable member is a harness for application to the body of the user.

18. The apparatus of claim 16, wherein said body attachable member is a jacket to be worn by the user.

19. The apparatus of claim 11, wherein said body securing device includes a body receiving member for receiving the body of the user.

20. The apparatus of claim 11, further comprising a descent control device for controlling the rate of descent of the user.

21. The apparatus of claim 20, wherein said descent control device comprises an oil damper disposed in association with the drum for retarding rotation of the drum.

22. The apparatus of claim 20, wherein said descent control device is adjustable to vary the rate of descent of the user.

* * * * *